US005826805A

United States Patent [19]

Ito et al.

[11] Patent Number: 5,826,805

[45] Date of Patent: Oct. 27, 1998

[54] ELECTROSTATIC COATING MACHINE

[75] Inventors: Tomoyasu Ito, Seto; Touichi Watanabe, Yokohama; Yasuo Ishiguro, Nagoya; Kengo Honma, Tokai, all of Japan

[73] Assignee: Trinity Industrial Corporation, Tokyo, Japan

[21] Appl. No.: 808,450

[22] Filed: Feb. 28, 1997

[30] Foreign Application Priority Data

Feb. 29, 1996 [JP] Japan ..... 8-042504

[51] Int. Cl.[6] ..... B05B 5/025; B05B 15/02

[52] U.S. Cl. ..... 239/691; 239/690; 239/693; 239/112; 239/119; 239/305

[58] Field of Search ..... 239/690, 691, 239/693, 699, 700, 708, 305, 126, 124, 119, 112, 106, 104

[56] References Cited

U.S. PATENT DOCUMENTS

| | | | |
|---|---|---|---|
| 4,915,599 | 4/1990 | Katsuyama et al. | 239/305 X |
| 5,100,057 | 3/1992 | Wacker et al. | 239/305 X |
| 5,152,466 | 10/1992 | Matushita et al. | 239/690 |
| 5,288,029 | 2/1994 | Ishibashi et al. | 239/691 |
| 5,288,525 | 2/1994 | Diana | 239/305 X |
| 5,655,896 | 8/1997 | Konieczynski | 239/691 X |

FOREIGN PATENT DOCUMENTS

| | | |
|---|---|---|
| 4-91755 | 8/1912 | Japan . |
| 4-63156 | 2/1992 | Japan . |
| 4-200664 | 7/1992 | Japan . |
| 4-87755 | 7/1992 | Japan . |
| 4-87756 | 7/1992 | Japan . |
| 4-87758 | 7/1992 | Japan . |
| 4-87759 | 7/1992 | Japan . |
| 4-87760 | 7/1992 | Japan . |
| 4-91756 | 8/1992 | Japan . |
| 6-57444 | 8/1994 | Japan . |
| 6-60451 | 8/1994 | Japan . |
| 6-60452 | 8/1994 | Japan . |

*Primary Examiner*—Lesley D. Morris
*Attorney, Agent, or Firm*—IP Group of Pillsbury Madison and Sutro LLP

[57] ABSTRACT

An electrostatic coating machine comprising at least two paint tanks (13A, 13B) for pushing out a paint by a pressure of a hydraulic fluid which one is attached to a rotary base (14) while being electrically insulated from each other, and can be positioned to a coating position opposed to the machine body (3) by the rotation of the rotary base (14) such that while one paint tank is at the coating position, the other paint tank is engaged with a paint charging attachment (22) that is disposed being electrically insulated from the machine body (3) and has a paint supply port (Ps) for supplying a cleaning fluid and a paint of a next color and a drain recovery port (Dr) for recovering drains. Cleaning/paint charging time can be shortened to improve operation efficiency and insulation countermeasure for the paint supply system can be saved.

4 Claims, 3 Drawing Sheets

ELECTROSTATIC COATING MACHINE

BACKGROUND OF THE INVENTION

1. Field of the Invention

The present invention concerns an electrostatic coating machine for conducting electrostatic coating by supplying a paint to an atomizing mechanism disposed to a machine body while applying a high voltage to the mechanism and, more in particular, it relates to an electrostatic coating apparatus suitable to electrostatic coating of an electro conductive paint such as an aqueous paint or a metallic paint.

2. Statement of the Prior Art

Electrostatic coating has been generally conducted by applying a high voltage from −80 to 120 kV to an electrostatic coating machine, while setting an article to be coated (hereinafter referred to as a work) to a ground potential, to form electrostatic fields between the electrostatic coating machine and the work, negatively charging paint particles atomized from the electrostatic coating machine and electrostatically coating the particles to the work as an anode of an opposite polarity.

In this case, when an electro conductive paint such as an aqueous paint or a metallic paint is coated by a electrostatic coating machine applied with a high voltage, it is necessary to provide insulation countermeasures over the entire paint supply system from the electrostatic coating machine by way of a paint supply pipeline to a paint supply source in order to prevent the high voltage applied to the electrostatic coating machine from leaking. Particularly, in a multi-color electrostatic coating apparatus for the coating of automobiles that conducts coating while changing colors of paints for as many as several tens of colors, it suffers from troubles that the paint supply system has to be insulated for the paint on every color.

In view of the above, the present applicant have already proposed electrostatic coating apparatus not requiring insulation countermeasures for the paint supply system for the paints on every color (Japanese Utility Model Laid-Open Hei 4-87755, 87756, 87758, 87759, 87760, 91755 and 91756, Japanese Patent Laid-Open Hei 6-57444, 60452, and Japanese Patent Laid-Open Hei 4-63156 and 200662).

FIG. 4 shows a schematic constitution of them, in which a paint tank 43 for discharging a predetermined amount of a paint entered from a paint entrance port 41 from a paint discharge port 42 at a predetermined flow rate by a cylinder 43*a* is connected with an electrostatic coating machine 44, and a paint supply pipeline 46 for supplying a paint of each color, a cleaning liquid and a cleaning air selectively from a color change device 45 to the tank 43 is connected to the tank 43.

In the midway of the paint supply pipeline 46, are interposed a coupler 47A connected to the color change device 45 and a coupler 47B changed to the electrostatic coating machine 44, and at least one coupler 47A is adapted to be retractable by a cylinder 48 such that the couplers are spaced apart from each other by an insulation distance and connected with each other disengageably.

In this constitution, the cylinder 48 is extended to connect each of the couplers 47A and 47B and store a paint in the paint tank 43 in a not-coating state in which a high voltage is not applied to the electrostatic coating machine 44. Then, coating is applied by retracting the cylinder 48 to disengage the couplers 47A and 47B from each other and spacing apart them by a predetermined insulation distance in a coating state in which the high voltage is applied to the electrostatic coating machine 44, thereby disconnecting the paint supply pipeline 46 and pushing out a paint stored in the tank 43 in a state where the color-change device 45 and the electrostatic coating machine 44 are insulated electrically.

Accordingly, it may suffice to provide the insulation countermeasure only from the electrostatic coating machine 44 to the coupler 47B connected therewith and there is no particular requirement for providing the insulation countermeasure to the paint supply pipeline 46 from each of paint supply sources (not illustrated) by way of the color change device 45 to the coupler 47A.

However, since a high voltage is applied to the electrostatic coating machine 44 also in this case, if the electrostatic coating machine 44 is used being attached to a lifting frame of an automatic coating device such as a top machine or being attached to the top end of a weaving arm of a coating manipulator, the electrostatic coating machine, the paint tank 43 and the like have to be supported under insulation to the lifting frame or the weaving arm and, in addition, the coupler 47A or the like of the paint supply pipeline 46 has to be supported separately.

As shown in FIG. 5, if a machine body 54 comprising a rotary atomizing head 52 or an air motor 53, a paint tank 43 and the like are assembled into a housing 51 of an electrostatic coating machine 44, the housing rear end 55 can be set to the ground potential and supported integrally.

However, also in the machine having a paint supply system in which the paint tank 43 interposed between the color change device 45 and the machine body 54, it still leaves a problem upon color-change that it takes a cleaning time for cleaning the residual paint in the paint tank 43 and a charging time for charging the paint of a next color.

That is, after completing the coating by a paint of a preceding color to the start of the coating by a paint of a next color, a residual paint present in the long paint supply system from the color change device 45 to the rotary atomizing head 52 has to be cleaned and removed by supplying a cleaning fluid such as a cleaning liquid or a cleaning air into the paint tank 43 and the rotary atomizing head 52 and, in addition, a reciprocally driven type paint tank 43 is interposed in the system. Accordingly, it takes much time for the cleaning operation. Further, since the paint of the next color has to be charged in the paint tank 43 after the completion of the cleaning, it results in a problem of taking much time also for the charging operation to lower the operation efficiency. This provides a bottleneck making it difficult to install the multi-color electrostatic coating machine on the automated coating line in which works are transported at a predetermined time interval.

For instance, in a coating line for automobile bodies, since a conveyer speed is about 5 to 7 m and a distance between the automobile bodies is 2–3 m, the time interval after the completion of the coating for the preceding automobile body to the start of coating for the succeeding automobile body is only about 30 sec, so that the cleaning operation and the paint charging operation as described above have to be completed within this interval. However, according to the experiment of the present inventors, et al, it has been found that it takes a time for about 15 sec only for the cleaning work and 45 sec for the paint charging operation.

In this case, the time for the cleaning operation can be shortened to about 10 sec by increasing the pressure of the cleaning solution and cleaning air to be supplied. However, when the paint is charged in the paint tank 43, it must be supplied at a low pressure since bubbles are. formed upon supply of a paint at a high pressure to result in coating failure and, accordingly, the charging time for the paint can not be shortened so much to bring about a problem of lowering the operation efficiency.

OBJECT OF THE INVENTION

In view of the above, it is a technical object of the present invention to utterly eliminate the requirement for the insulation countermeasure to coating equipments for supporting an electrostatic coating machine and paint supply systems connected thereto, and enable color change coating with no lowering for the operation efficiency even in a case where a preceding article to be coated with a paint of a preceding color and a succeeding article to be coated by a paint of a next color are transported continuously.

SUMMARY OF THE INVENTION

The foregoing object can be attained in accordance with the present invention by an electrostatic coating machine for conducting electrostatic coating by supplying a paint to an atomizing mechanism disposed to a machine body while applying a high voltage to the mechanism, the machine comprising;

at least two paint tanks (13A, 13B) for pushing out a paint by a pressure of a hydraulic fluid attached to-a rotary base (14), while being electrically insulated from each other, and disposed such that they can be positioned to a coating position opposed to the machine body (3) by the rotation of the rotary base (14), a paint connector (9) in communication with the atomizing mechanism (7) and provided to the machine body (3) at a position for engaging a paint outlet (Pout) of the paint tank (13A, 13B) positioned to a coating position, and a paint charging attachment (22) being electrically insulated from the machine body (3) and comprising a paint supply port (Ps) for supplying a cleaning fluid and a paint of each color to the paint tank (13B, 13A) and a drain recovery port (Dr) for recovering drains discharged from the paint tank (13B, 13A), said paint supply port (Ps) and said drain recovery port (Dr) being positioned at a paint charging position opposed to and engaged with the paint inlet (Pin) and the paint outlet (Pout) of the paint tank (13B, 13A) when the other tank (13A, 13B) is positioned to the coating position.

According to the present invention, since at least two paint tanks for pushing out a paint by the pressure of the hydraulic fluid are attached to the rotary base and can be positioned to the coating position by rotating the rotary base, and since the paint connector is disposed to the machine body for engagement with the paint outlet of the positioned paint tank, when the paint outlet of one of the paint tanks positioned to the coating position is engaged with the paint connector disposed to the machine body and the hydraulic fluid is supplied to the paint tank, the paint in the paint tank is pushed out by the pressure of the fluid and atomized by the atomizing mechanism disposed to the machine body.

Further, when one of the paint tanks is positioned to the coating position, the other of the tanks is positioned to the paint charging position, so that it is possible to engage the paint supply port and the drain recovery port to the paint inlet and the paint outlet of the other of the paint tanks, to clean the inside thereof and charge the paint of the next color. Accordingly, even if the cleaning operation and the charging operation takes a somewhat long time, the operations are conducted in parallel with the coating operation and can be completed and caused to stand-by during the coating period by the paint of the preceding color.

Then, coating by the paint of the succeeding color can be conducted by rotating the rotary base at the instance the coating for the paint of the preceding color has been completed, positioning the paint tank charged with the paint of the succeeding color to the machine body and supplying a hydraulic fluid by engaging the paint outlet to the paint supply connector, so that coating efficiency is not lowered.

In this case, if the cleaning supply port capable of engaging to and disengaging from the paint connector is disposed to the rotary base and the cleaning solution supply port is engaged to the paint connector to supply the cleaning fluid when coating by the paint of the preceding color has been completed, the paint of the preceding color remaining in the atomizing mechanism disposed to the machine body or deposited to the connector can be cleaned and removed in a short period of time.

Then, at the instance the cleaning has been completed for the atomizing mechanism or the connector, when the rotary base is rotated so as to position the paint tank charged with the paint of the succeeding color to the coating position and coating to the succeeding work by the paint of the succeeding color is started coating by the paint of the succeeding color can be started again with only a short period of time of interruption while reliably preventing color mixing.

Further, during coating by the paint of the succeeding color, the paint supply port and the drain recovery port can be engaged to the paint inlet port and the paint outlet of the paint tank used for supplying the paint of the preceding color so far can be engaged to the paint supply port and the drain recovery port, thereby cleaning the inside of the tank and charge the paint of the further succeeding color.

Further, even if a high voltage applied to one of the paint tanks engaged to the machine body upon coating, since each of the paint tank is insulated electrically from each other and the paint supply port and the drain recovery port are also disposed being insulated electrically from the machine body, a high voltage does not leak even if the paint supply port connected with a paint pipeline as a member grounded to the earth is engaged to the other of the paint tank to be charged with the paint and, accordingly, it is not required to provide insulation countermeasure to the paint pipeline or the like for supplying paint to other paint tank.

Further, in this case, when each of the paint tanks is disposed within a cup-shaped insulation cover opened at the top end face opposed to the machine body, and having airtightly formed circumferential surface and rear end face and the rear end of the insulation cover is attached to the rotary base, it is only necessary to space apart the exposed portions of the paint tanks contained in the insulation covers from each other by a predetermined insulation distance and they can be kept at a state insulated from each other when the paint tanks are disposed closer to each other, so that the radius of the rotational portion can be reduced and the entire size can be reduced to make the electrostatic coating machine compact.

DESCRIPTION OF THE ACCOMPANYING DRAWINGS

The present invention will be explained by way of preferred embodiment according to the present invention illustrated in the drawings, wherein.

DESCRIPTION OF PREFERRED EMBODIMENTS

Figure 1:
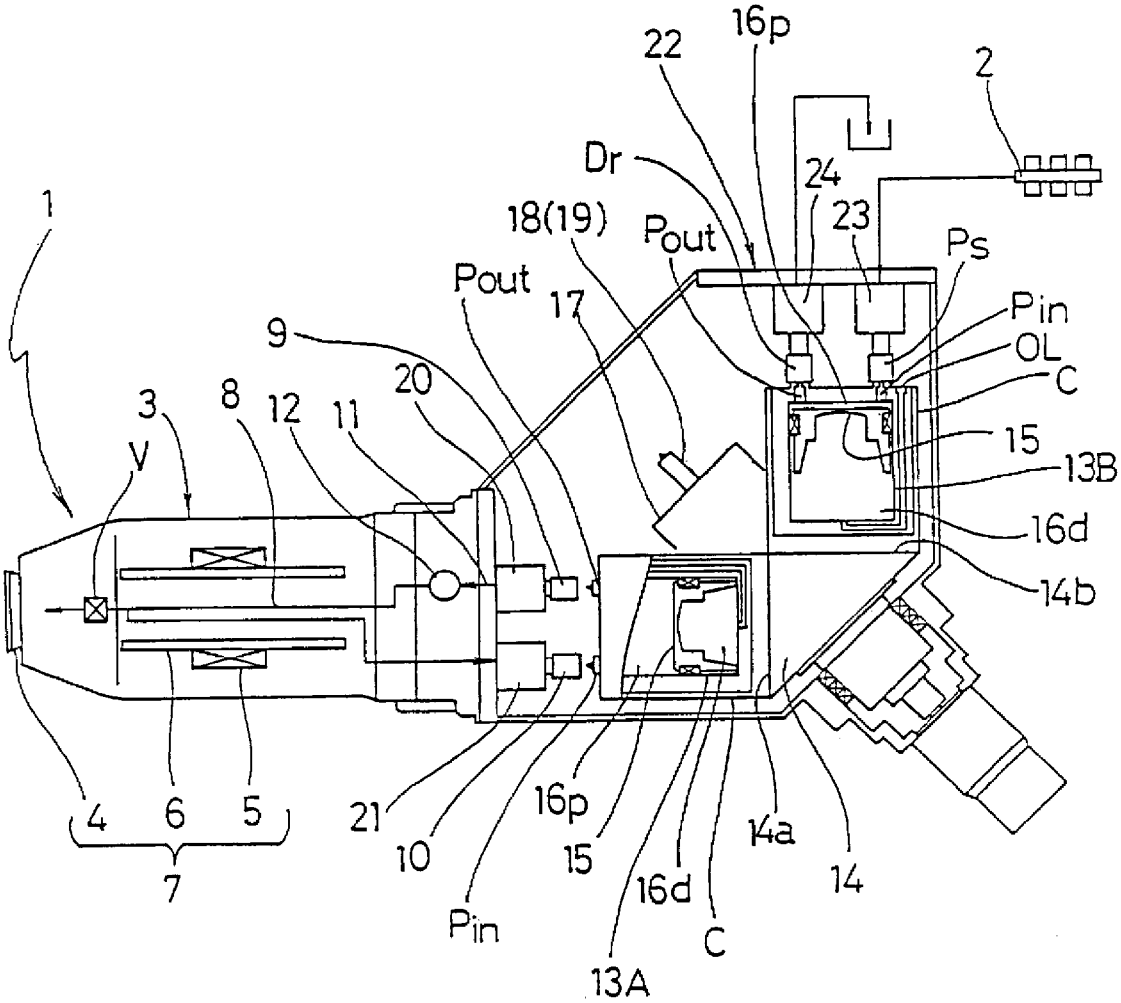
FIG. 1 is a schematic constitutional view illustrating a preferred embodiment of an electrostatic coating machine according to the present invention.
Figure 2:
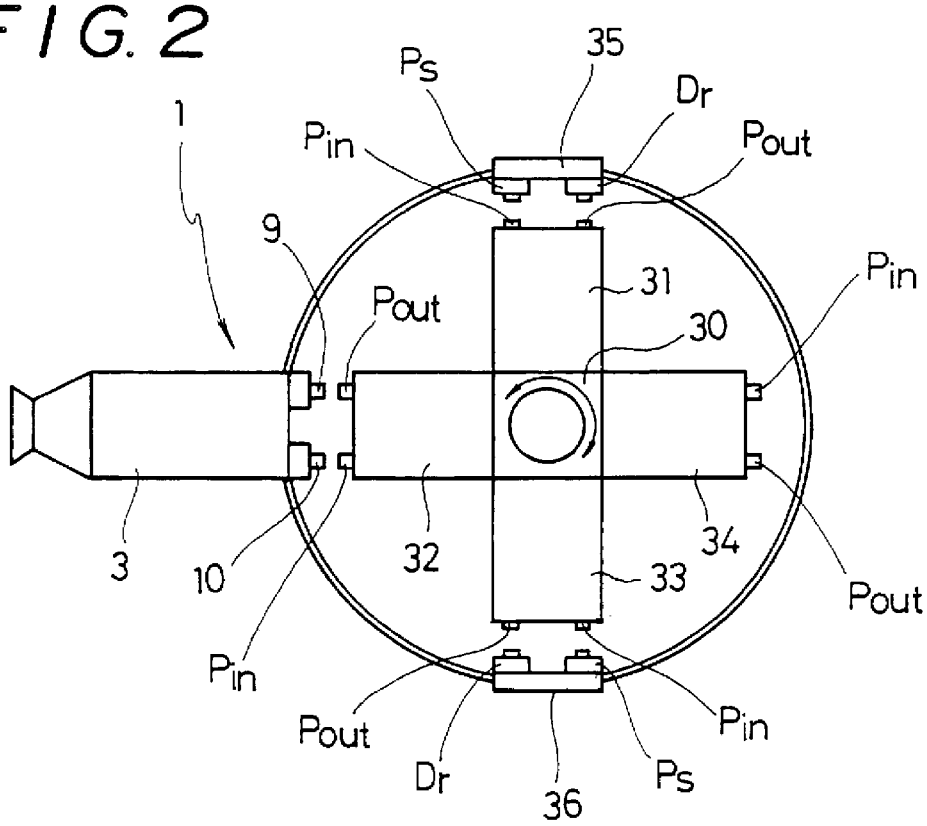
FIG. 2 is a schematic constitutional view illustrating another preferred embodiment of an electrostatic coating machine according to the present invention.
Figure 3:
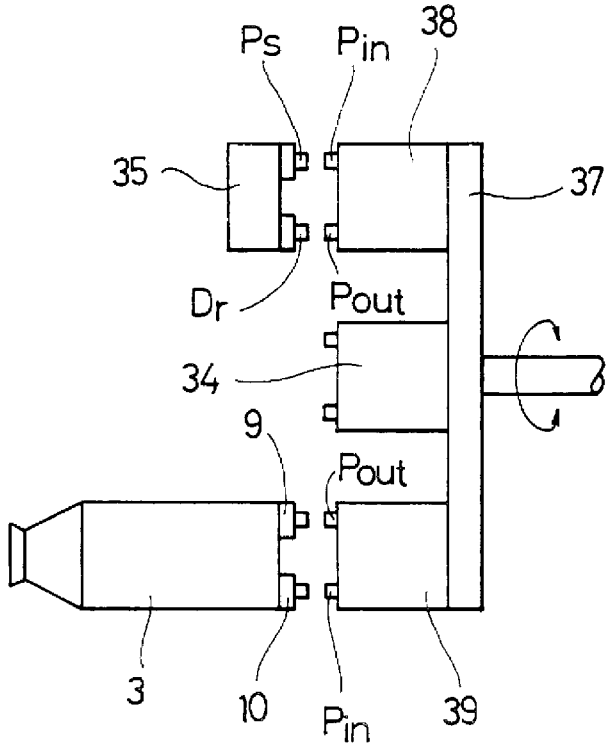
FIG. 3 is a schematic constitutional view illustrating a further preferred embodiment of an electrostatic coating machine according to the present invention.
Figure 4:
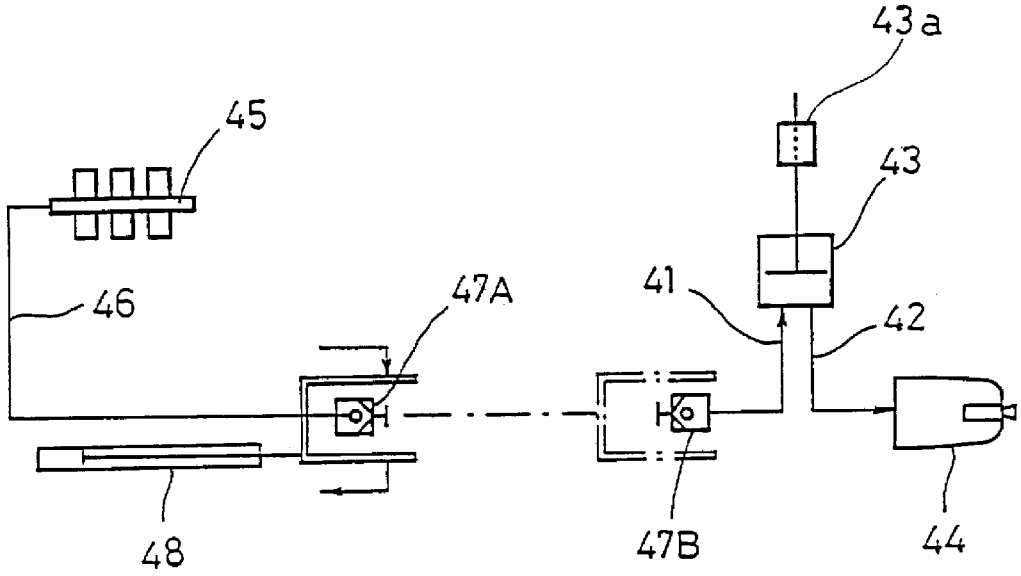
FIG. 4 (PRIOR ART)
FIG. 4 is a schematic constitutional view illustrating an electrostatic coating machine of the prior art.
Figure 5:
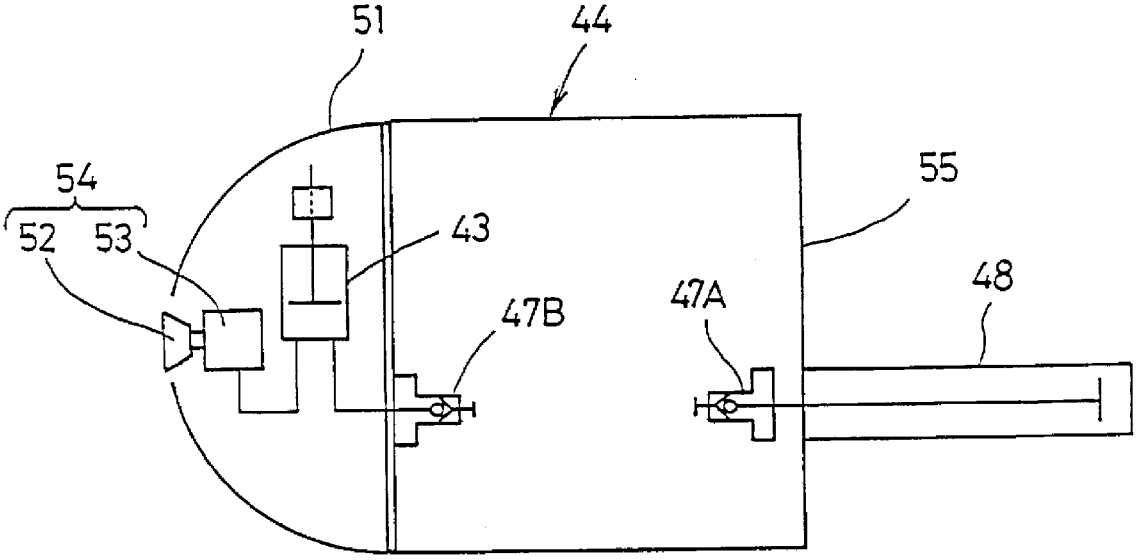
FIG. 5 (PRIOR ART)
FIG. 5 is a schematic constitutional view illustrating of the coating machine a prior art.

FIG. 1 is a schematic explanatory view illustrating an electrostatic coating machine according to the present invention, FIG. 2 and FIG. 3 are schematic explanatory views showing other preferred embodiments.

In the drawing, reference numeral 1 denotes an electrostatic coating machine connected to a color change device for selectively supplying a cleaning fluid such as a cleaning liquid or cleaning air and paints of various colors, in which a machine body 3 is provided with an atomizing mechanism 7 comprising a rotary atomizing head 4 attached to a rotational tubular shaft 6 of an air motor 5, a fine tubular nozzle 8 is inserted through the rotational tubular shaft 6 for supplying a paint to the rotary atomizing head 4, and a paint supplied through the fine tubular nozzle 8 is atomized while applying a high voltage supplied from a high voltage generator (not illustrated) attached to the machine body 3 to the rotary atomizing head 4 and driving the air motor 5 to rotate the rotary atomizing head 4 at a high speed.

At the back of the machine body 3, are disposed a paint connector 9 in communication with the fine tubular nozzle 8 and a drain connector 10 for discharging drains from the fine tubular nozzle 8, and an air operated regulator 12 for supplying a paint at a constant flow rate is intervened to a pipeline connecting the paint connector 9 and the fine tubular nozzle 8.

Behind the machine body 3, at least two paint tanks 13A, 13B for pushing out a paint under the pressure of an hydraulic fluid such as air or a hydraulic oil are attached while being electrically insulated from each other to a rotary base 14, and disposed such that each of them can be positioned to a coating position relative to the machine body 3 by rotating the rotary base 14. In this embodiment, the rotary base 14 is formed into a square pyramidical shape and the tanks 13A and 13B are secured to slopes 14*a*, 14*b* which are opposite with respect to the rotational center.

Each of the paint tanks 13A and 13B is contained and disposed in a cup-shaped insulation cover C which is opened at a top end face opposed to the machine body 3 and made airtight for the circumferential surface and the rear end face, a paint inlet Pin, a paint outlet Pout and an hydraulic fluid inlet/outlet OL are disposed in communication with the inside of each of the paint tanks 13A, 13B or the insulation cover C, and the insulation cover C is attached at the rear end to the rotary base 14 and exposed portions of the paint tanks 13A and 13B contained in the insulation covers C are attached being electrically insulated from each other and spaced apart by a predetermined insulation distance.

An internal piston 15 is disposed to each of the paint tanks 13A and 13B for partitioning the tank into a paint chamber 16*p* and a hydraulic fluid chamber 16*d*, and adapted such that the internal piston 15 is urged upon coating by the pressure of the hydraulic fluid supplied from a hydraulic fluid supply hose (not illustrated) by way of the hydraulic fluid inlet/outlet OL to the hydraulic fluid chamber 16*d*, by which a paint charged in the paint chamber 16*p* is pushed-out upon coating, while the internal piston 15 is returned upon charging by the supply pressure of a paint supplied from the paint inlet Pin to the paint chamber 16*p* to charge the paint while pushing-out the hydraulic fluid from the operation chamber.

Further, a cleaning attachment 17 for cleaning to remove a residual paint in the rotary atomizing head 4 or the fine tubular nozzle 8 is attached to one of the inclined surfaces of the square pyramidical rotary base 14 not attached with the paint tanks 13A and 13B.

The cleaning attachment 17 has a cleaning fluid supply port 18 for supplying a cleaning fluid and a drain recovery port 19 for recovering drains circulated from the tubular nozzle 8 or the pipeline 11.

Further, the paint connector 9 of the machine body 3 is disposed at a position engaging the paint outlet Pout for the paint tank 13A, 13B positioned to the coating position and the cleaning fluid supply port 18 of the cleaning attachment 17 positioned to the coating position, and the drain connector 10 is disposed at a position engaging the drain recovery port 19 of the cleaning attachment 17 positioned to the coating position.

Further, there are disposed cylinders 20 and 21 for advancing and retracting the paint connector 9 and the drain connector 10 and engaging them, for example, to the paint outlet Pout, the cleaning fluid supply port 18 and the drain recovery port 19 when the paint tank 13A, 13B or the cleaning attachment 17 is positioned to the coating position.

Reference numeral 22 denotes a paint charging attachment which is opposed to the paint tank 13B (13A) when the other paint tank 13A (13B) is positioned to the coating position and which is disposed at a paint charging position insulated electrically from the machine body 3. The attachment 22 has a paint supply port Ps which is engaged with a paint inlet Pin for the paint tank 13A, 13B positioned at the charging position and supplying a cleaning fluid and a paint of each color to the inside thereof and a drain recovery port Dr which is engaged with a paint outlet Pout for recovering the drains discharged from the paint tank 13A or 13B, and also has cylinders 23, 24 for contracting and extending each of the ports Ps, Dr to engage or disengage them to and from the paint inlet Pin and a paint outlet Pout of the paint tank 13A, 13B.

Further, a check valve is disposed to the top end for each of the paint connector 9 and the drain connector 10 disposed at the back of the machine body 3, the paint inlet Pin and the paint outlet Pout disposed to the paint tank 13A, 13B, the cleaning fluid supply port 18 and the drain recovery port 19 of the cleaning attachment 17, and the paint supply port Ps and the paint outlet Pout of the paint charging attachment 22, such that the valves are opened only upon engagement and closed upon detachment.

An example of the constitution of the present invention has been described above, and explanation will be made to the operation thereof in a case of applying coating in the order of a white paint and a red paint.

At first, when a white paint is charged to one paint tank 13A, the paint tank 13A is positioned to a charging position by the rotation of the rotary base 14, and the paint supply port Ps of the paint charging attachment 22 is engaged to the paint inlet Pin of the paint tank 13A and, when a white paint is supplied in this state from a color change device 2, the internal piston 15 is retracted and a hydraulic fluid is discharged from the hydraulic fluid chamber 16*d* and the white paint is charged in the paint chamber 16*p*.

Then, when the charging of the white paint in the paint chamber 16*p* of the tank 13A is completed, the cylinder 23 is contracted to disengage the paint supply port Ps and the paint inlet Pin.

Then, for conducting coating, the paint tank 13A is moved from the charging position to the coating position and positioned by rotating the rotary base 14 by 180°, the cylinder 20 is extended to engage the paint connector 9 disposed at the back of the machine body 3 to the paint outlet Pout of the paint tank 13 and caused to stand-by in this state. Then, when the hydraulic fluid is supplied to the hydraulic fluid chamber 16*d* of the paint tank 13A upon arrival of a preceding article to be coated (a work), the internal piston 15 is urged by the pressure, the white paint in the paint chamber 16*p* is fed by way of the paint regulator 12 at a constant flow rate from the fine tubular nozzle 8 to the rotary atomizing head 4 to conduct coating by the white paint.

Meanwhile, a red paint as a next color is charged to the other paint tank 13B positioned to the charging position.

In this case, since the white paint remains in the paint flow channel from the color change device 2 to the paint supply port Ps, the residual paint is at first removed by cleaning.

That is, during coating conducted by pushing out the paint from one paint tank 13A, since the other paint tank 13B is positioned to the charging position, cylinders 23, 24 are extended to engage the paint supply port Ps and the drain recovery port Dr to the paint inlet Pin and paint outlet Pout of the paint tank 13B, and a cleaning fluid such as a cleaning liquid or cleaning air is supplied from the color change device 2. Then, the residual white paint in the route from the color change device 2 to the paint supply port Ps is washed out, and the drains are passed through the paint chamber 16B of the paint tank 13B, discharged from the paint outlet Pout, and recovered from the drain recovery port Dr to a drain tank. If the paint of the preceding color remains in the paint tank 13B, the residual paint can also be removed thoroughly by cleaning.

Then, after the completion of the cleaning, when the cylinder 24 is contracted, the paint outlet Pout of the paint tank 3B is closed and when the red paint is supplied from the color change device 2, the hydraulic fluid is discharged from the hydraulic fluid chamber 16*d* while retracting the internal piston 15, and the red paint is charged in the paint chamber 16*p*.

In this case, the paint tanks 13A and 13B are attached being insulated from each other on the rotatory base 14, and the paint charging attachment 22 is disposed at a position spaced apart by a predetermined insulation distance from the machine body 3. Accordingly, if the paint is charged to the paint tank 13B by connecting the paint-supply port Ps of the paint charging attachment 22 connected with a paint pipeline as a number grounded to the earth during coating under the application of a high voltage to the paint tank 13A at the coating position, no high voltage is leaked and, therefore, it is no more necessary to provide an insulation countermeasure for the paint supply system from a paint supply source (not illustrated) by way of the color change device 2 to the paint supply port Ps.

Then, when the coating with the white paint is concreted and color is changed for the red paint, the residual paint in the atomizing mechanism 7 disposed to the machine body 3 is removed by cleaning.

At first, the cylinder 20 is contracted to thereby retract the paint connector 9 disposed at the back of the machine body 3 and disengaged from the paint outlet Pout of the paint tank 13A. In this state the rotary base 4 is rotated by 90° to position the cleaning attachment 17 to the cleaning position. Then, the cylinders 20, 21 are extended, and the paint connector 9 and the drain connector 10 of the machine body 3 are connected with the cleaning liquid supply port 18 and the drain recovery port 19 of the cleaning attachment 17.

Then, when the needle valve V at the top end of the fine tubular nozzle 8 is closed and a cleaning fluid such as cleaning liquid or cleaning air is supplied from the cleaning fluid supply port 18, the paint in the paint connector 9, the pipeline 11, the air operated regulator 12 and the fine tubular nozzle 8 is discharged together with the drains from the drain connector 10 to the drain recovery port 19. Then, when the needle valve V at the top end of the fine tubular nozzle 8 is opened, the rotary atomizing head 4 is cleaned.

When the cleaning for the atomizing mechanism 7 is completed, the rotary base 14 is now further rotated by 90° in the same direction as in the previous case, thereby positioning the paint tank 13B to the coating position and the paint connector 9 of the machine body 3 is engaged with the paint outlet Pout of the paint tank 13B in the same manner as described above and coating by the red paint is conducted. In this case, since the paint tank 13A is positioned at the charging position, cleaning and charging of the paint in the paint tank 13A are conducted by the paint charging attachment 22 in the same manner as in the preceding procedure.

As described above, since the two paint tanks 13A and 13B can be used and successively alternately for coating, while coating is applied by one paint tank 13A (13B), the inside of the other paint tank 13B (13A) can be cleaned and charged with the paint. Accordingly, cleaning operation for color change and paint charging operation for each of the tanks 13A, 13B can be conducted with a sufficient margin in view of time and since color change coating can be conducted after sufficiently cleaning to remove the residual paint even if the transportation interval of works is short, coating failure such as color mixing is not caused.

The present invention is not restricted to the case of attaching the two paint tanks 13A and 13B and the cleaning attachment 17 to the square pyramidical rotary base 14 but, as shown in FIG. 2, three sets of paints tanks 31–33 and a cleaning attachment 34 may be attached to a block-shaped rotary base 30. In this case, the charging position is set at 2 points to which paint charging attachments 35, 36 are disposed respectively.

Further, as shown in FIG. 3, a plurality of paint tanks 38, 39 may be attached at rear ends thereof to a disk-shaped rotatory base 37.

As has been described above according to the present invention, since a plurality of paint tanks are used alternately such that while coating is conducted by one of them, cleaning can be applied by the other, it has an excellent advantageous effect capable of conducting color change coating without deteriorating the operation efficiency even in a case where the preceding article to be coated with a paint of a preceding color and the succeeding article to be coated with a paint of a next color are transported successively.

Further, since each of the paint tanks is attached being insulated from each other to the rotary base and the paint is charged at the paint charging position spaced apart by a predetermined insulation distance relative to the machine body to which the high voltage is applied, the high voltage does not leak even if the rear end of the electrostatic coating machine is at the ground potential, so that it can be attached as it is to a lifting frame of an automatic coating machine or an weaving arm of a coating manipulator as it is, and also has an excellent effect capable of eliminating the requirement for insulation countermeasure of coating equipments for supporting an electrostatic coating machine and paint supply systems for supplying the paint to them.

Further, when the cleaning attachment is attached to the rotary base, the atomizing mechanism in the machine body can be cleaned at a higher efficiency after completing the coating for the paint of a preceding color and before starting of the coating with a paint of a next color, thereby enabling to prevent color mixing surely.

Further, when each of the paint tanks is contained and disposed in a cup-shaped insulation cover, and the rear end is attached to the rotary base, since it may suffice to space apart the top ends of the paint tanks exposed from the insulation covers by a predetermined insulation distance from each other and the paint tanks can be maintained to each other in an insulated state even if they are disposed in adjacent with each other, there is no requirement for spacing apart the rear ends of the paint tanks applied with the high voltage from each other by a insulation distance, so that the radius of the rotary portion can be reduced, and the entire structure can be reduced in the size to make the electrostatic coating machine compact.

What is claimed is:

1. An electrostatic coating machine for conducting electrostatic coating by supplying a paint, while applying a high voltage to an atomizing mechanism (7) disposed to a machine body (3), said machine comprising;

at least two paint tanks (13A, 13B) for pushing out a paint by a pressure of a hydraulic fluid attached to a rotary base (14), while being electrically insulated from each other, and disposed such that they can be positioned to a coating position opposed to the machine body (3) by the rotation of the rotary base (14), a paint connector (9) in communication with the atomizing mechanism (7) and provided to the machine body (3) at a position for engaging a paint outlet (Pout) of the paint tank (13A, 13B) positioned to a coating position, and a paint charging attachment (22) being electrically insulated from the machine body (3) and comprising a paint supply port (Ps) for supplying a cleaning fluid and a paint of each color to the paint tank (13B, 13A) and a drain recovery port (Dr) for recovering drains discharged from the paint tank (13B, 13A), said paint supply port (Ps) and said drain recovery port (Dr) being positioned at a paint charging position opposed to and engaged with the paint inlet (Pin) and the paint outlet (Pout) of the paint tank (13B, 13A) when the other tank (13A, 13B) is positioned to the coating position.

2. An electrostatic coating machine as defined in claim 1, wherein a cleaning fluid supply means (18) is attached to the machine body (3) for supplying a cleaning fluid to the atomizing mechanism (7) when the cleaning fluid supply means (18) is engaged with a paint connector (9) disposed to the machine body (3).

3. An electrostatic coating machine as defined in claim 1, wherein each of the paint tanks (13A and 13B) is contained and disposed in a cup-shaped insulation cover (C) which is opened at the top end face opposed to the machine body (3) and made airtight at the circumferential surface and the rear end face, a paint inlet (Pin), a paint outlet (Pout) and a hydraulic fluid inlet/outlet (OL) in communication with the paint tank (13A, 13B) are disposed to the top end of the paint tank (13A, 13B) or the insulation cover (C), the rear end of the insulation cover (C) is attached to the rotary base (14), and the exposure portions of the paint tanks (13A, 13B) contained in the insulated cover (C) are spaced apart from each other by a predetermined insulation distance.

4. An electrostatic coating machine as defined in claim 2, wherein each of the paint tanks (13A and 13B) is contained and disposed in a cup-shaped insulation cover (C) which is opened at the top end face opposed to the machine body (3) and made airtight at the circumferential surface and the rear end face, a paint inlet (Pin), a paint outlet (Pout) and a hydraulic inlet/outlet (OL) in communication with the paint tank (13A, 13B) are disposed to the top end of the paint tank (13A, 13B) or the insulation cover (C), the rear end of the insulation cover (C) is attached to the rotary base (14), and the exposure portions of the paint tanks (13A, 13B) contained in the insulated cover (C) are spaced apart from each other by a predetermined insulation distance.

* * * * *